United States Patent [19]

Hanna et al.

[11] 4,319,733

[45] Mar. 16, 1982

[54] LOCKING SPRING CLIP

[75] Inventors: Nabil S. Hanna, Harrisburg; John R. Shuey, Carlisle, both of Pa.

[73] Assignee: AMP Incorporated, Harrisburg, Pa.

[21] Appl. No.: 114,450

[22] Filed: Jan. 22, 1980

[51] Int. Cl.[3] ..... H01R 13/62

[52] U.S. Cl. ..... 248/507; 248/505; 339/91 R; 174/52 R

[58] Field of Search ..... 248/500, 507, 508, 510, 248/509, 505; 339/91 R, 75 R, 75 M, 75 P; 174/52 R

[56] References Cited

U.S. PATENT DOCUMENTS

| | | | |
|---|---|---|---|
| 1,893,241 | 1/1933 | Mong | 248/507 X |
| 2,895,118 | 7/1959 | Huetten et al. | 248/505 X |
| 3,970,353 | 7/1976 | Kaufman | 339/91 R X |
| 4,008,942 | 2/1977 | Grossi | 339/91 R |

FOREIGN PATENT DOCUMENTS

| | | | |
|---|---|---|---|
| 2447105 | 8/1980 | France | 339/91 R |
| 694729 | 7/1953 | United Kingdom | 248/500 |

*Primary Examiner*—Peter P. Nerbun

[57] ABSTRACT

A locking spring clip is disclosed for lockingly securing mating electrical connector members together. The subject clip includes a resilient latching member and a further locking member acting in cooperation therewith.

6 Claims, 3 Drawing Figures

LOCKING SPRING CLIP

BACKGROUND OF THE INVENTION

1. The Field Of The Invention

The present invention relates to a locking spring clip for electrical connectors.

2. The Prior Art

The conventional latching mechanisms of electrical connectors have two primary disadvantages. First they can accidentally become unlatched if struck by a glancing blow, and second there is always the possibility that the initial application may be incorrect so that full latching is never completely achieved. In either case the same undesirable effect of unmating of the connectors would result. Further, such unmating could likely involve damage to the terminals of the connector during the inadvertant unmating.

SUMMARY OF THE INVENTION

The present invention is a locking spring clip formed from a single piece of resilient spring metal folded upon itself to define a base with first and second cantilever arms extending therefrom in spaced relation. The first arm includes a latching lug directed away from the second arm and an actuating projection forming a stepped shoulder directed toward the second arm. The second arm is of lesser overall length than the first arm, but of greater length than from the base to the shoulder so that upon latching of the latching lug the second arm can be positioned against the shoulder to secure the clip in a latched condition. The base includes means for assembling the clip on an electrical connector of any known design.

It is therefore an object of the present invention to produce an improved locking clip which will assure positive retention of mated electrical connectors.

It is a further object of the present invention to produce an improved latching clip which requires a positive action to effect unlatching of the clip thereby obviating unintentional unmating of mated connector members.

It is a further object of the present invention to produce a latching clip which can be readily and economically produced.

The means for accomplishing the foregoing objects and other advantages of the present invention will become apparent from the following detailed description taken with reference to the accompanying drawings.

DETAILED DESCRIPTION OF THE PREFERRED EMBODIMENT

Figure 1:
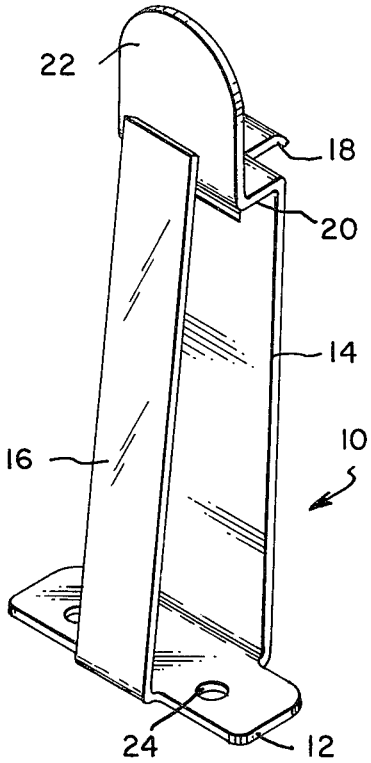
FIG. 1 is a perspective view of a locking spring clip according to the present invention.

The subject spring locking clip 10 has a base portion 12 with a first cantilever arm 14 and a second cantilever arm 16 extending from opposite sides of the base portion in substantially parallel spaced relationship. The first arm 14 has a latching lug 18 extending therefrom in a first direction away from the second arm and a step or shoulder 20 directed towards the second arm. An actuation extension 22 extends from the shoulder 20 as an offset continuation of the first arm. The second arm 16 has a length less than the overall length of the first arm 14 but greater than the distance between the base portion 12 and the shoulder 20. The locking spring clip also includes mounting apertures 24 in the base portion 12.

Figure 2:
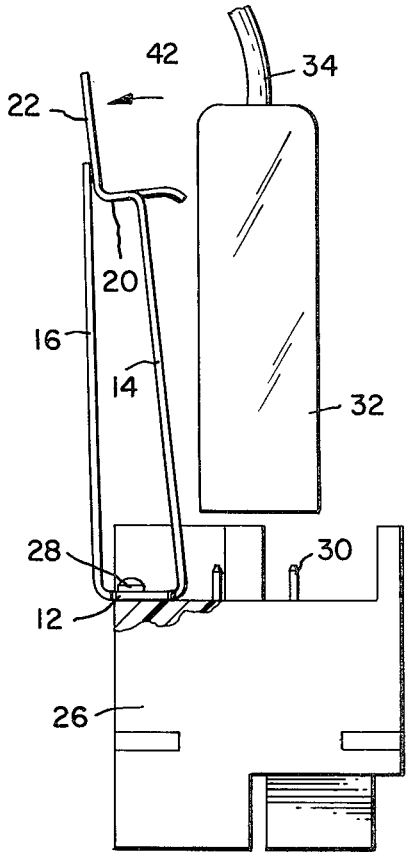
FIG. 2 is a side elevation of the subject locking spring clip mounted on a connector which is shown schematically.
Figure 3:
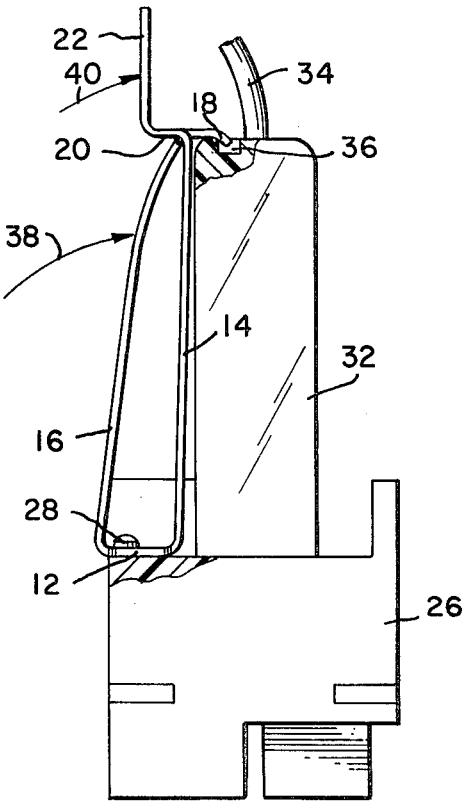
FIG. 3 is a view similar to FIG. 2 showing the connector in a mated latched and locked condition.

The subject locking spring clip is shown in FIGS. 2 and 3 as it would be mounted on a header 26 of a connector by means of screws or bolts 28. The header 26 includes a plurality of fixed terminals 30 aligned to mate with terminals (not shown) of a plug 32 terminating a cable 34. The length of the first arm 14 from the base portion 12 to the latching lug 18 is substantially the same as the length of the plug 32. When the plug 32 is fully mated on the header 26, the first arm 14 is swung to the position shown in FIG. 3 with the latching lug 18 engaging a rear surface and/or detent 36 of the plug. The second arm 16 is then pushed against the first arm 14, in the direction of arrow 38, until the free end of the second arm is retained by the shoulder 20 and applies pressure thereto. In this position unintended disengagement of the locking spring clip is prevented by the second arm. The clip is released by application of pressure on the extension 22, in the direction of arrow 40, to release the second arm 16 from shoulder 20. The first arm 14 can then be rotated, in the direction of the arrow 42 in FIG. 2, to release the latching lug 18 from the rear surface of the plug. Thus the plug is freed for removal from the header.

The present invention may be embodied in other forms without departing from the spirit or essential characteristics thereof. The present embodiment should therefore be considered in all respects as illustrative and not restrictive of the scope of the invention.

What is claimed is:

1. A locking spring clip for securing electrical connector members together in a mated condition, said clip comprising:

a base, first and second spaced arms extending from opposite sides of said base in cantilever fashion, said first arm having a latching lug extending therefrom in a direction away from said second arm and a stepped shoulder directed towards said first arm, said second arm having a length slightly greater than the length from the base to said shoulder whereby in a latched condition said lug engages a rear surface of a mated connector member and said second arm is positioned beneath said shoulder under compression to prevent the unintended disengagement of said lug.

2. A locking spring clip according to claim 1 wherein:

said lug and said shoulder are substantially equal distant from said base.

3. A locking spring clip according to claim 1 further comprising:

means on said base for mounting said clip on an electrical connector.

4. A locking spring clip for securing mating electrical connector members together in a locked condition, said clip comprising:

an elongated piece of resilient metal folded upon itself to define a base with first and second spaced arms extending from opposite sides thereof in cantilever fashion, said first arm having a latching lug extending therefrom in a first direction away from the second arm and a stepped shoulder extending in a second opposite direction towards said first arm, said second arm having a length slightly greater than the length from the base to said shoulder, whereby in a latched condition said lug engages a rear surface of a mated connector member and said second arm is positioned beneath said shoulder to prevent the unintended disengagement of said lug.

5. A locking spring clip according to claim 4 wherein:

said latching lug and said shoulder are substantially equal distance from said base.

6. A locking spring clip according to claim 4 further comprising:

mounting means associated with said base for mounting said clip on an electrical connector.

* * * * *